United States Patent [19]

Furey

[11] Patent Number: 4,843,925

[45] Date of Patent: Jul. 4, 1989

[54] NAIL HOLDING HAMMER ATTACHMENT

[76] Inventor: Thomas Furey, 218 Middlesex Ave., Voorhees, N.J. 08043

[21] Appl. No.: 155,877

[22] Filed: Feb. 16, 1988

Related U.S. Application Data

[63] Continuation-in-part of Ser. No. 47,266, May 8, 1987.

[51] Int. Cl.[4] ..... B25C 1/00

[52] U.S. Cl. ..... 81/23

[58] Field of Search ..... 81/23, 24, 44; 7/143, 7/146, 147, 170; 24/31 V, 300–302, 3 R, 3 M

[56] References Cited

U.S. PATENT DOCUMENTS

| | | | |
|---|---|---|---|
| 365,255 | 6/1887 | Hoover | 81/23 X |
| 587,623 | 8/1897 | Treat | 81/23 |
| 869,835 | 10/1907 | Fowler | 81/23 |
| 2,574,304 | 11/1951 | Vigil | 81/23 |
| 3,125,143 | 3/1964 | Wilson | 81/23 |
| 4,270,587 | 6/1981 | Ludy | 81/23 |
| 4,432,504 | 2/1984 | Pace | 24/81 V X |
| 4,596,540 | 6/1986 | F'Geppert | 24/31 V X |

*Primary Examiner*—James G. Smith

*Attorney, Agent, or Firm*—Robert K. Youtie

[57] ABSTRACT

A nail holding attachment for a hammer including a generally flat, relatively rigid back plate, a generally flat resiliently flexible holding sheet overlying the back plate, opposite side edge portions of the back plate being folded over into clamping engagement with adjacent side portions of the holding sheet, a notch extending inwardly from an unsecured edge of the holding sheet and converging inwardly to define a pair of resiliently flexible frictional lips for holding engagement with a nail, the back plate being attached to a hammer for holding a nail while starting penetration of the nail.

6 Claims, 1 Drawing Sheet

NAIL HOLDING HAMMER ATTACHMENT

CROSS-REFERENCES TO RELATED APPLICATIONS

This application is a Continuation-in-Part of my copending U.S. patent application Ser. No. 47,266, filed May 8, 1987 and entitled NAIL HOLDING ATTACHMENT FOR A HAMMER.

BACKGROUND OF THE INVENTION

This invention is concerned with devices for temporarily holding a nail to initiate penetration of the nail, as when the location is inaccessible for manually holding the nail for starting its penetration.

In this highly developed art applicant is aware of many prior patents, as set forth in said parent application, and incorporated herein by reference.

Of the known prior art, it appears the Swiss patent to Vigil No. 566,846 is probably the closest. However, this prior patent requires the pocket 24 with lips 25 formed in the hammer head and the flat metal leaf or spring 30 in the pocket for holding engagement with a nail.

The use of the metal spring 30 makes insertion of the nail rather difficult, and the spring is subject to rapid wear causing cracking and loss of holding ability. Also, the construction in the prior patent is quite expensive.

SUMMARY OF THE INVENTION

Accordingly, it is an important object of the present invention to provide a nail holder for a hammer which is greatly simplified in construction, requiring only a sheet metal backing plate and a resiliently flexible holding sheet of frictional material clamped to the backing plate. The assembly may be attached to a hammer by a unique attachment device affording quick and easy attachment and removal, or may be permanently attached by the simple expedient of cementing to the hammer.

The nail holding device of the instant invention is more easily utilized in that it is only necessary to flex the holding sheet, which may advantageously be of plastic or rubber, rather than flex a metal leaf spring; and, that the plastic holding sheet will be long lasting in use, and the instant device is very economical to manufacture so as to economically justify its discard when desired.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figure 3:
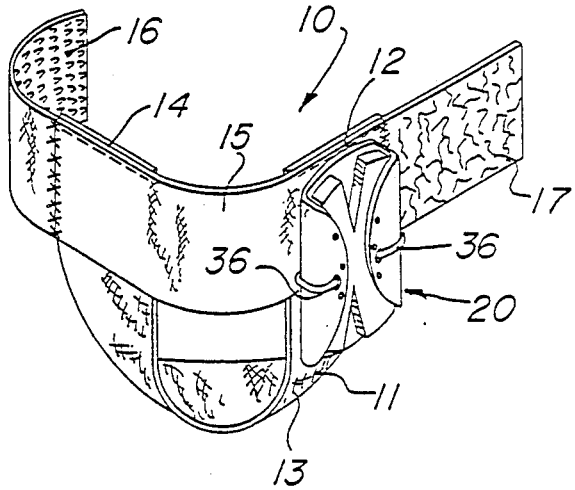
FIG. 3 is a perspective view showing the nail holding device of FIGS. 1 and 2 apart from a hammer.

Referring now more particularly to the drawings, and specifically to FIG. 3 thereof, a nail holding attachment of the present invention is there generally designated 10.

The attachment 10 includes a loop 11 of elastic or stretchable strip material. More specifically the loop 11 may be generally U-shaped extending from one end 12 downwardly through a curved or bight portion 13, and thence upwardly to an opposite end 14. Extending across the loop 11, as between loop end portions 12 and 14, is a strap 15, which may also be of the same resiliently extensile or elastic strip material. The strap 15 may be suitably secured, as by stitching or other securement means to the loop end portion 12, passing thence across the loop for suitable securement to the loop end portion 14.

Extensions of the strap 15, as beyond opposite ends thereof, are provided by tee strip portion 16 extending beyond the loop end portion 14, and the strap extension 17 extending beyond the loop end portion 12. The strap extensions 16 and 17 may be suitably secured, as by stitching, or the like, to the loop end portions 14 and 12. Further, the strap extensions 16 and 17 may be of fastener fabric type material, such as is sold under the trademark VELCRO. This fastener fabric material is well known to be self-securing upon movement into facing engagement, and to release upon relative peeling or stripping.

Carried adjacent to one end of loop 11, particularly adjacent to the loop end of 12, may be a nail head receiver of the present invention, generally designated 20. The nail head receiver may be secured exteriorly in facing relation with the loop 11 and strap 15 adjacent to the loop end 12.

Figure 1:
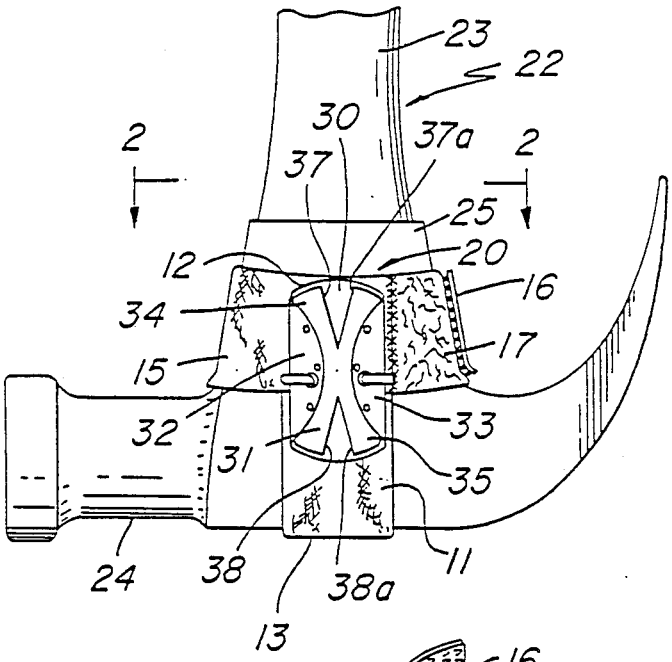
FIG. 1 is an elevational view showing a nail holder of the present invention attached to a hammer.
Figure 2:
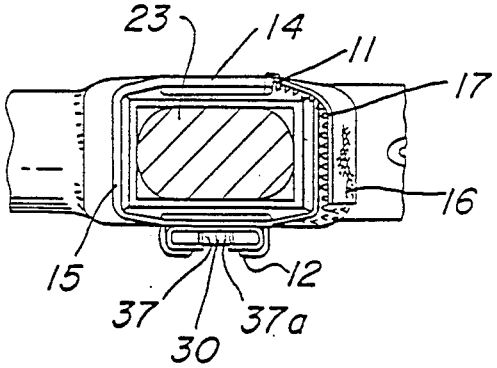
FIG. 2 is a transverse sectional view taken generally along the line 2—2 of FIG. 1.

Referring now to FIGS. 1 and 2, there is shown a hammer 22 including an elongate handle 23 and a transverse head 24 carried by and extending across the lower end of the handle, as seen in FIG. 1. The head may include a sleeve 25.

The nail holding device 10 of FIG. 3 is illustrated in operative conjunction with the hammer 22. One end of the hammer head 24, the left hand end as seen in FIG. 1, has been inserted through the closed loop defined by strip 11 and strap 15. The strap 15 then extends partly about the handle 23, or the sleeve 25, which receives the handle.

The strap extension 16 may then be continued about the handle 23, and secured closely thereabout by fastening engagement of the fastener elements 16 and 17, as seen in FIGS. 1 and 2.

Thus, the strap 15 and its extensions 16 and 17 snugly embrace the hammer handle 23, and sleeve 25, and the loop 11 extends closely about the hammer head 24, adjacent to the handle 23, placing the nail head receiver 20 on one side of the hammer head 24.

The nail head receiver 20 includes a relatively stiff or rigid backing sheet or plate 30, say of sheet metal, and a layer of flexible, frictional sheet material, such as vinyl or other plastic sheeting, designated 31. The resiliently flexible, frictional sheeting 31 overlies the back plate 30, and is secured in position relative to the back plate, as by opposite longitudinal side edge portions 32 and 33 of the back plate being folded to overlie the adjacent side edge portions 34 and 35 of the sheet 30 and secure the latter in position on the back plate Thus, the nail head receiver 20, including the back plate 30 extends generally longitudinally of the hammer handle 23, on one side of the hammer head 24, being held in position on the hammer head by the attachment device 12–17, or a spot of cement, as desired.

The nail receiver 20 may be secured to the attachment device 12–17, as by stitching 36 and 37 extending respectively through inturned plate edge portions 32 and 33, the holding sheet 31, and the underlying portion of loop 11.

The resiliently flexible holding sheet 31 of frictional material extends longitudinally of and overlies the backing sheet 30, having its longitudinal side edges 34 and 35 anchored to the backing sheet by the respective inturned sheet portions 32 and 33.

Thus, the end edges of the holding sheet 31 overlie the backing sheet 30 and are unsecured thereto or free thereof. Extending inwardly from opposite end edges of the holding sheet 31 are respective inwardly convergent notches or cut-outs 37 and 38. As the material of holding sheet 31 is resiliently flexible, the portions along the notches or convergent cut-outs 37 and 38 define resiliently flexible lips for overlying, holding engagement with a nail head inserted therebeneath, and frictional holding engagement with a nail shank engaged therebetween.

That is, the flat plate 30 may engage against the head of a nail which enters beneath the edge portions of a notch 37 or 38, while the shank of the nail is frictionally engaged by the notch edge portions.

More particularly, the generally V-shaped cut-out or notch 37 defines frictional lips 37*a* of its side edge portions, while the holding sheet material bounding the V-shaped notch 38 define frictional holding lips 38*a*.

While the operation is believed apparent from the foregoing description, it will be understood that a nail may be inserted into one of the notches 37, 38, with its head against the backing plate 30, and releasably held in this position for initial penetration of the nail into a work piece. After initial penetration, the nail may be readily removed from the nail holder and nail penetration concluded in the conventional manner.

While the pair of notch formations 37 and 38 may be utilized, respectively, for low and high nailing, either notch may be used for holding a wide range of sizes and types of nails. If desired, the notches 37 and 38 may be sized differently for smaller and larger nails. However, it has been found that a single notch will accommodate and hold a wide range of nail sizes. Further, the notches 37 and 38 of the present invention serve admirably well to hold nails without heads, such as finishing nails.

From the foregoing, it is seen that the nail holding attachment of the present invention is extremely simple in construction and operation for convenience in use, and economy in manufacture, even justifying discard after a short period.

Although the present invention has been described in some detail by way of illustration and example for purposes of clarity of understanding, it is understood that certain changes and modifications may be made with the spirit of the invention.

What is claimed is:

1. A nail holding attachment for a hammer having an elongate handle and a transverse head, said attachment comprising a loop engageable over a hammer head, a strap extending across said loop for passage partly about the hammer handle, an extension on said strap for passing about the remainder of the hammer handle, fastener means connecting the strap extension about the handle, and at least one nail head receiver on said loop for halding a nail to be started, said loop being elastic for snug engagement over a hammer head adjacent to the hammer handle, said nail head receiver being adjacent to one end of said strap for location on one side of the hammer head, said nail head receiver comprising a back plate, a generally flat resiliently flexible holding sheet of frictional material overlaying said back plate, securing means securing a pair of opposite edges of said holding sheet to said back plate, and a notch in said holding sheet extending inwardly from a remaining edge, said notch being convergent inwardly to define of its side edge portions a pair of resiliently flexible lips for deflection by a frictional holding engagement with a nail inserted in said notch.

2. A nail holding attachment according to claim 1, said fastener means comprising mating fastener fabrics on said strap and strap extension.

3. A nail holding attachment according to claim 2, said strap being elastic for snug engagement about the hammer handle and selectively adjustable securement of the fastener fabrics.

4. A nail head receiver comprising a back plate, a strap of "Velcro" on one side of and carrying said back plate, a generally flexible resilient holding sheet of frictional material overlaying the other side of said back plate, securing means securing a pair of opposite edges of said holding sheet to said back plate, and a notch in said holding sheet extending inwardly from a remaining edge, said notch being convergent inwardly to define of its side edge portions a pair of resiliently flexible frictional lips for deflection by and frictional holding engagement with a nail inserted in said notch.

5. A nail head receiver according to claim 4 said securing means comprising a pair of apposite edge portions of said back plate folded over into clamping engagement with said pair of opposite edges of said holding sheet.

6. A nail head receiver according to claim 4, in combination with an additional notch extending from an edge of said holding sheet opposite to said remaining edge and being convergent inwardly to define of its side edge portions a pair of resiliently flexible frictional lips for deflection by a frictional holding engagement with a nail inserted in said additional notch.

* * * * *